US005916721A

United States Patent [19]

Soeda et al.

[11] Patent Number: 5,916,721

[45] Date of Patent: Jun. 29, 1999

[54] COLORED TONER FOR ELECTROPHOTOGRAPHY

[75] Inventors: Kaori Soeda; Yoshiaki Kobayashi; Meizo Shirose, all of Hachioji, Japan

[73] Assignee: Konica Corporation, Japan

[21] Appl. No.: 08/920,110

[22] Filed: Aug. 26, 1997

[30] Foreign Application Priority Data

Aug. 27, 1996 [JP] Japan ..... 8-225197

[51] Int. Cl.[6] ..... G03G 9/09

[52] U.S. Cl. ..... 430/106; 430/109

[58] Field of Search ..... 430/106, 109, 430/110

[56] References Cited

U.S. PATENT DOCUMENTS 4,085,057 4/1978 Masuda et al. ..... 430/106

4,957,841 9/1990 Macholdt et al. ..... 430/106

5,246,810 9/1993 Hagiwara et al. ..... 430/106

*Primary Examiner*—John Goodrow

*Attorney, Agent, or Firm*—Jordan B. Beirman; Bierman, Muserlian and Lucus

[57] ABSTRACT

Disclosed is a color toner for developing an electrostatic latent image, said color toner comprising a binder resin and an azomethine dye having absorption at visible wavelength region or near-infrared wavelength region represented by Formula 1:

$$A{=}N{-}B \qquad \text{Formula 1}$$

wherein said A represents an atomic group, N is a nitrogen atom and said B represents a non-metal atomic group necessary to form an aromatic hydrocarbon ring, a five-membered heterocyclic aromatic ring or a six-membered heterocyclic aromatic ring.

8 Claims, No Drawings

COLORED TONER FOR ELECTROPHOTOGRAPHY

FIELD OF THE INVENTION

The present invention relates to a colored toner which is employed in color copiers and color printers utilizing an electrophotographic process.

BACKGROUND OF THE INVENTION

Conventionally, in color copiers and color printers utilizing the electrophotographic method, a toner has been generally employed wherein a colorant is dispersed into resin particles.

Another toner is also employed wherein the colorant is adhered on the surfaces of resin particles. For example, Japanese Patent Publication Open to Public Inspection Nos. 63-23166, 63-2075 and 4-243267 propose methods wherein the colorant is mechanically or chemically adhered on. However, according to such methods, the surface of the toner is only colored and it is difficult to obtain the sufficient coloring effect. Furthermore, problems have been caused such that the desorption, etc. is caused on the surface and electrification properties vary, and in the above-mentioned system in which a heat roller is employed, the roller surface is stained.

Accordingly, the toner has been widely employed wherein the colorant is dispersed into the interior of a resin particle. As properties required for color tone of such the toner, not only color reproduction and image transparency for an overhead projector (hereinafter referred to as OHP) but also light fastness is enumerated in order to maintain consistently these properties.

The above-mentioned OHP image transmission rate means the OHP image transmission rate, and a degree of the variation in hue between the color of light transmitted through the OHP image and the color of light obtained by the reflection of the transmitted light on paper. When a toner comprising a pigment as the colorant is employed, good light fastness is obtained. However, on account of insolubility of the pigment, a dispersed particle having a diameter of tens of nm to hundreds of nm is formed and problems such as the decrease in the transparency and the hue variation in the color of transmitted light are caused. When the toner is employed which comprises a disazo pigment such as C.I. PIGMENT YELLOW 12, 13, 14, 16, 17, etc. described, for example, in Japanese Patent Publication Open to Public Inspection Nos. 2-210363, 62-157051 and 62-255956, and C.I. PIGMENT YELLOW 185 described in Japanese Patent Publication Open to Public Inspection No. 6-118715, the pigment is insoluble and tends to coagulate to form dispersed particle having a diameter of tens of nm to hundreds of nm through the secondary particle and further tertiary particle. As a result, problems such as the decrease in saturation and transparency of the OHP image are caused.

As the countermeasures against those, the pigment is previously treated by a flushing method, a master batch method, etc. and the resulting treated pigment has been employed. When employing the countermeasure, the increase in cost is not avoided because of the increase in the number of the manufacturing process. On the other hand, when the toner comprising a dye as the colorant is employed, the transparency of the OHP image is excellent because the dye is soluble and is fully dispersed. However, there is provided a problem such that the light fastness is inferior to that of the pigment. There have been known dyes such as C.I. SOLVENT YELLOW 162 described in Japanese Patent Publication Open to Public Inspection No. 3-276161, C.I. DIRECT YELLOW 160 described in Japanese Patent Publication Open to Public Inspection No. 2-207274, C.I. SOLVENT YELLOW 112 described in Japanese Patent Publication Open to Public Inspection No. 2-207273, etc. These dyes enable to obtain the OHP image having high transparency and no hue variation. However, as compared to the pigment, the light fastness is inferior and the consistent properties cannot be obtained for a long period of time.

SUMMARY OF THE INVENTION

An object of the present invention is to provide a colored toner which results in an image having high saturation without previous treatment of a colorant, excellent light fastness, and small variation in hue and high transparency of an OHP image.

In order to accomplish the above-mentioned object, inventors of the present invention have investigated diligently and have found that the above-mentioned object is accomplished by a colored toner comprising an azomethine dye described in the present invention.

(1) In a colored toner comprising at least a resin and a colorant, the color toner for electrophotography wherein said colorant comprises at least an azomethine dye represented by Formula 1:

$$A{=}N{-}B \qquad \text{Formula 1}$$

wherein A represents an atomic group required for enabling an azomethine dye to absorb visible ray region and/or near infrared region and B represents a non-metallic atomic group required for forming an aromatic hydrocarbon ring or 5-membered or 6-membered aromatic heterocyclic ring.

DETAILED DESCRIPTION OF THE INVENTION

In the Formula 1, B is preferably the following Formulas B-1 to B-14.

Formula B-1

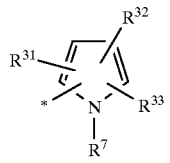

Formula B-2

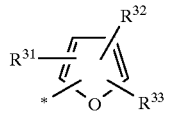

Formula B-3

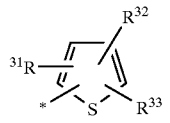

-continued

Formula B-4

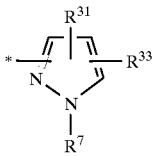

Formula B-5

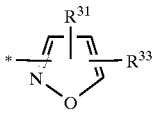

Formula B-6

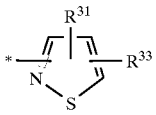

Formula B-7

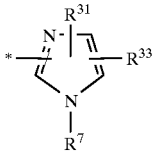

Formula B-8

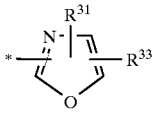

Formula B-9

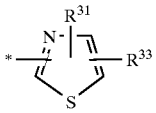

Formula B-10

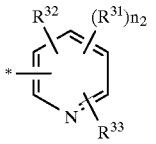

Formula B-11

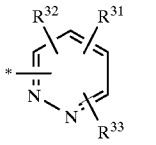

Formula B-12

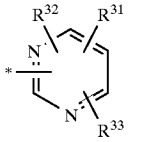

-continued

Formula B-13

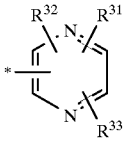

Formula B-14

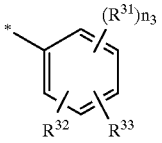

In the Formulas B-1 to B-14, $R^7$ represents an alkyl group or an aryl group, $R^{33}$ represents $OR^{34}$ or $NR^{35}R^{36}$, and $R^{34}$, $R^{35}$ and $R^{36}$ independently represent a hydrogen atom, an alkyl group, an aryl group or a heterocyclic group. Furthermore, $R^{35}$ and $R^{36}$, and $R^{35}$ and B, and $R^{36}$ and B may form a ring in combination and further, B may have a condensed ring. $R^{34}$, $R^{35}$ and $R^{36}$ each represent a hydrogen atom, an alkyl group, an aryl group or a heterocyclic group and these may be substituted with a substituent combined with an alkyl group, an alkenyl group, an alkinyl group, a hydroxyl group, a nitro group, a carboxyl group, a cyano group, a halogen atom, an aryl group, a heterocyclic group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, an alkyl sulfonyl group, an aryl sulfonyl group a carbamoyl group, a sulfamoyl group, an alkoxycarbonyl group, a heterocyclicoxy group, an alkylazo group, an arylazo group, an acyloxy group, a carbamoyloxy group, a silyl group, a silyloxy group, an aryloxycarbonylamino group, a imido group, a heterocyclicthio group, a sulfinyl group, a phosphono group, a phosphinyl group, a phosphoryl group, a phospho group, a phosphino group, an aryloxycarbonyl group or an acyl group. $R^{35}$ and $R^{36}$ each may represent the same or different group. In more detail, examples of $R^{34}$, $R^{35}$ and $R^{36}$ are shown. The alkyl group includes a straight or branched chain or cyclic alkyl having from 1 to 12 carbon atoms and preferably from 1 to 6 carbon atoms. Examples include methyl, ethyl, propyl, isopropyl, t-butyl, 2-hydroxyethyl, 3-hydroxypropyl, benzyl, 2-methylsulfonamidoethyl, 3-methylsulfonamidopropyl, 2-methylsulfonylethyl, 2-methoxyethyl, cyclopentyl, 2-acetoamidoethyl, 2-methoxycarbonylethyl, 2-carbamoylethyl, hexyl, 2-hydroxypropyl, 4-hydroxybutyl, 2-cyanoethyl and 2-acetoxyethyl. The aryl group includes an aryl group having from 6 to 18 carbon atoms and preferably from 6 to 12 carbon atoms, and for example, phenyl, naphtyl or p-methoxyphenyl. The heterocyclic group includes a saturated or unsaturated 5-membered or 6-membered heterocyclic group having from 1 to 5 carbon atoms and at least one of an oxygen atom, a nitrogen atom and a sulfur atom and the number of the hetero atom, which constitutes a ring, may be one or plural. Examples include 2-furyl, 2-thienyl, 2-pyrimidinyl, 2-benztriazolyl, imidazolyl and pyrazolyl. R35 and $R^{36}$ may be combined to form a ring.

Though no formed ring is particularly limited, a group of rings composed of carbon atoms, oxygen atoms, nitrogen atoms and sulfur atoms are preferred. Examples include a pyrrolidinyl group, a piperazinyl group and a morpholino group. Those rings may have substituents which are available for $R^{35}$. $R^{35}$ and $R^{36}$ each are preferably an unsubstituted alkyl group or an alkyl group substituted with a substituent combined with a hydroxyl group, an alkoxycarbonyl group, a cyano group, an alkoxy group, an acylamino group, an acyloxy group and sulfonamido group. $R^{31}$ and $R^{32}$ represent independently a hydrogen atom, a halogen atom, an alkyl group, an aryl group, a heterocyclic group, a cyano group, a nitro group, a hydroxyl group, a carboxyl group, an alkoxy group, an aryloxy group, an acylamino group, an amino group, an alkylamino group, an anilino group, a ureido group, sulfamoylamino group, an alkylthio group, an arylthio group, an alkoxycarbonylamino group, a sulfonyl amino group, a carbamoyl group, a sulfamoyl group, an alkylsulfonyl group, an arylsulfonyl group, an alkoxycarbonyl group, a heterocyclicoxy group, an alkylazo group, an arylazo group, a silyloxy group, an aryloxycarbonylamino group, an imido group, a heterocyclicthio group, a sulfinyl group, a phosphono group, a phosphinyl group, a phosphoryl group, a phospho group, a phosphino group, an aryloxycarbonyl group and an acyl group. These may be substituted with an alkyl group, an alkinyl group, an aryl group, a hydroxyl group, a nitro group, a cyano group, a halogen atom, a carboxylic acid group, a sulfonic acid group or another substituent formed by oxygen atoms, nitrogen atoms, sulfur atoms or carbon atoms. In more detail, examples of the substituents of $R^{31}$ are shown. The halogen atoms include, for example, a fluorine atom, a chlorine atom. The alkyl group includes straight, branched chain or cyclic alkyl groups having from 1 to 12 carbon atoms and preferably from 1 to 6 carbon atoms and for example, methyl, ethyl, propyl, isopropyl, t-butyl, 2-hydroxycarbonylethyl, 2-methoxyethyl, benzyl, 2-methylsulfonylaminoethyl, 2-methylsulfonylethyl, cyclopentyl or 2-acetoamidoethyl. The aryl group includes aryl groups having from 6 to 18 carbon atoms and for example, phenyl, naphthyl or p-hydroxycarbonylphenyl. The heterocyclic group includes 5-membered or 6-membered heterocyclic groups having at least one of an oxygen atom, a nitrogen atom and a sulfur atom and from 1 to 5 carbon atoms. The examples include 2-furyl, 2-thienyl, 2-pyrimidinyl, 2-benztriazolyi, imidazolyl and pyrazolyl. The alkoxy group includes alkoxy groups having from 1 to from 12 carbon atoms and preferably from 1 to 6 carbon atoms and for example, methoxy, ethoxy or 2-methoxyethoxy. The aryloxy group includes aryloxy groups having 6 to from 18 carbon atoms and for example, phenoxy, p-methoxyphenoxy or p-tolyloxy. The acylamino group includes acylamino groups having from 1 to 12 carbon atoms and preferably from 1 to 6 carbon atoms, and for example, acetoamido, 2-methoxypropionamido or benzoylamino. The alkylamino group includes alkylamino groups having from 1 to 12 carbon atoms and preferably from 1 to 6 carbon atoms, and for example, dimethylamino, diethylamino, 2-hydroxymethylamino, 2-hydroxyethylamino, 2-hydroxypropylamino or 2-hydroxylbutylamino. The anilino group includes anilino groups having 6 to 18 carbon atoms, and for example, anilino, m-nitroanilino or N-methylanilino. The ureido group includes ureido groups having from 1 to 12 carbon atoms and preferably from 1 to 6 carbon atoms, and for example, methylureido or N,N-dimethylureido. The sulfamoylamino group includes sulfamoyl groups having from 0 to 12 carbon atoms and preferably from 0 to 6 carbon atoms, and for example, dimethylsulfamoylamino or methylsulfamoylamino. The alkylthio group includes alkylthio groups having from 1 to 12 carbon atoms and preferably from 1 to 8 carbon atoms, and for example, a methylthio group, an ethylthio group or 2-phenoxyethylthio group. The arylthio group includes arylthio groups having from 6 to 18 carbon atoms and for example, a phenylthio group or a 4-cyanophenylthio group. The alkoxycarbonylamino group includes alkoxycarbonylamino groups having from 2 to 12 carbon atoms and preferably from 2 to 6 carbon atoms, and for example, methoxycarbonylamino, ethoxycarbonylamino or 3-methylsulfonylpropoxycarbonylamino. The sulfonylamino group include sulfonylamino groups having from 1 to 12 carbon atoms and preferably from 1 to 6 carbon atoms, and for example, a methylsulfonylamino group, a p-toluenesulfonylamino group or 2-methoxyethanesulfonylamino group. The carbamoyl group includes carbamoyl groups having from 1 to 12 carbon atoms and preferably from 1 to 6 carbon atoms, and for example, a carbamoyl group, an N,N-dimethylcarbamoyl group or an N-ethylcarbamoyl group. The sulfamoyl group includes sulfamoyl groups having from 0 to 12 carbon atoms and preferably from 0 to 6 carbon atoms, and for example, a sulfamoyl group, a dimethylsulfamoyl group or an ethylsulfamoyl group. The sulfonyl group includes aliphatic or aromatic sulfonyl groups having from 1 to 12 carbon atoms and preferably from 1 to 6 carbon atoms, and for example, a methylsulfonyl, ethylsulfonyl or 2-chloroethylsulfonyl group. The alkoxycarbonyl group includes alkoxycarbonyl groups having from 1 to 12 carbon atoms and preferably from 1 to 6 carbon atoms, and for example, a methoxycarbonyl, ethoxycarbonyl or t-butoxylcarbonyl group. The heterocyclicoxy group includes 5-membered or 6-membered saturated or unsaturated heterocyclicoxy groups having from 1 to 5 carbon atoms and at least one of an oxygen atom, nitrogen atom or sulfur atom, wherein the number of the hetero atom may be one or plural, and for example, a 1-phenyltetrazolyl-5-oxy, 2-tetrahydropyranyloxy or 2-pyridyloxy group. The azo group includes alkylazo groups having from 1 to 12 carbon atoms and preferably from 1 to 6 carbon atoms or an arylazo group, and for example, a phenylazo, 2-hydroxy-4-propanoylphenylazo or 4-methylsulfonylphenylazo group. The acyloxy group includes acyloxy groups having from 1 to 12 carbon atoms and preferably from 1 to 6 carbon atoms, and for example, an acetoxy, benzoyloxy or 4-hydroxybutanoyloxy group. The carbamoyloxy group includes carbamoyloxy groups having from 1 to 12 carbon atoms and preferably from 1 to 6 carbon atoms, and for example, an N,N-dimethylcarbamoyloxy, N-methylcarbamoyloxy or N-phenylcarbamoyloxy group. The silyl group includes silyl groups having from 3 to 12 carbon atoms and preferably from 3 to 6 carbon atoms, and for example, a trimethylsilyl, isopropyldiethlsilyl or t-butyldimethylsilyl group. The silyloxy group includes silyloxy groups having from 3 to 12 carbon atoms and preferably from 3 to 6 carbon atoms, and for example, a trimethylsilyloxy, triethylsilyloxy or diisopropylethylsilyloxy group. The aryloxycarbonylamino group includes aryloxycarbonylamino groups having from 7 to 24 carbon atoms and for example, a phenoxycarbonylamino, 4-cyanophenoxycarbonylamino or 2,6-dimethoxyphenoxycarbonylamino group. The imido group includes imido groups having from 4 to 12 carbon atoms and for example, an N-succinmido or N-phthalimido group. The heterocyclicthio group includes 5-membered or 6-membered saturated or unsaturated heterocyclicthio groups having from 1 to 5 carbon atoms and at least one of an oxygen atom, nitrogen atom or sulfur atom, wherein the number of the hetero atom may be one or plural, and for example, a 2-benzthiazolylthio or 2-pyrizylthio group. The sulfinyl group includes sulfinyl groups having from 1 to 12 carbon atoms and preferably from 1 to 6 carbon atoms, and for example, a methylsulfinyl, benzenesulfinyl or ethanesulfinyl group. The phosphono group includes phosphono groups having from 2 to 12 carbon atoms and preferably from 2 to 6 carbon atoms, and for example, a methoxyphosphono, ethoxyphosphono or phenoxyphosphono group. The phosphinyl group includes phosphinyl groups having from 2 to 12 carbon atoms and preferably from 2 to 6 carbon atoms, and for example, a methoxyphosphinyl, ethoxyphosphinyl or phenoxyphosphinyl group. The phosphoryl group includes phosphoryl groups having from 2 to 12 carbon atoms and preferably from 2 to 6 carbon atoms, and for example, a methoxyphosphoryl, ethoxyphosphoryl or phenoxyphosphoryl group. The phospho group includes phospho groups having from 2 to 12 carbon atoms and preferably from 2 to 6 carbon atoms, and for example, a methoxyphospho, ethoxyphospho or phenoxyphospho group. The phosphino group includes phosphino groups having from 2 to 12 carbon atoms and preferably from 2 to 6 carbon atoms, and for example, a methoxyphosphino, ethoxyphosphino or phenoxyphosphino group. The aryloxycarbonyl group includes aryloxycarbonyl groups having from 7 to 24 carbon atoms and for example, a phenoxycarbonyl, 2-methylphenoxycarbonyl or 4-sulfophenoxycarbonyl group. The acyl includes acyl groups having from 1 to 12 carbon atoms and preferably from 1 to 7 carbon atoms, and for example, an acetyl, benzoyl group or 4-chlorobenzoyl group. Furthermore, when $R^{31}$ is a hydroxyl group, an amino group or an alkylamino group, the compounds represented by the Formulas B-1 to B-14 may take tautomer structures. Needless to say, the Formulas B-1 to B-14 may include the compounds such tautomers. Among those, $R^{31}$ is preferably a hydrogen atom, a halogen atom, an alkyl group having from 1 to 6 carbon atoms, an aryl group having from 6 to 12 carbon atoms, an acylamino group having from 1 to 6 carbon atoms, a dialkylamino group having from 2 to 12 carbon atoms, a ureido group having from 1 to 6 carbon atoms, a sulfamoylamino group having from 2 to 12 carbon atoms, an alkoxycarbonylamino group having from 1 to 6 carbon atoms, a sulfonylamino group having from 1 to 6 carbon atoms, a carbamoyl group having from 1 to 6 carbon atoms, sulfamoyl group having from 2 to 12 carbon atoms, an arylsulfonyl group or an alkylsulfonyl group having from 1 to 6 carbon atoms, an alkoxycarbonyl group having from 2 to 6 carbon atoms, an acyl group having from 1 to 6 carbon atoms, a carboxylic acid group and a sulfonic acid group, and more preferably a hydrogen atom, an alkyl group having from 1 to 6 carbon atoms, an aryl group having from 6 to 12 carbon atoms, a cyano group, an alkoxy group having from 1 to 6 carbon atoms, an acylamino group having from 1 to 6 carbon atoms, a dialkylamino group having from 2 to 12 carbon atoms, a ureido group having from 1 to 6 carbon atoms, a sulfamoylamino group having from 2 to 12 carbon atoms, an alkoxycarbonylamino group having from 1 to 6 carbon atoms, an arylsulfonylamino group, an alkylsulfonylamino group having from 1 to 6 carbon atoms, a carbamoyl group having from 1 to 6 carbon atoms, a sulfamoyl group having from 2 to 12 carbon atoms, an arylsulfonyl group, an alkylsulfonyl group having from 1 to 6 carbon atoms, an alkoxycarbonyl group having from 2 to 6 carbon atoms, a carboxylic acid group and a sulfonic acid group. $R^{32}$ represents a hydrogen atom, an alkyl group, an aryl group, a heterocyclic group, a hydroxyl group, an alkoxy group, an aryloxy group, an acylamino group, an amino group, an alkylamino group, an anilino group, a ureido group, a sulfamoylamino group, an alkylthio group, an arylthio group, an alkoxycarbonylamino group, a sulfonylamino group, a sulfamoyl group, an arylsulfonyl group, an alkylsulfonyl group, a heterocyclicoxy group, an acyloxy group, a carbamoyloxy group, an aryloxycarbonylamino group, an imido group, a heterocyclicthio group. Those groups may be substituted with an alkyl group, an alkenyl group, an alkinyl group, an aryl group, a hydroxyl group, a nirto group, a cyano group, a halogen atom, a carboxylic acid group, a sufonic acid group or other substituents composed of oxygen atoms, nitrogen atoms, sulfur atoms or carbon atoms. The specific examples are the same as those in the explanation of $R^{31}$. $R^{32}$ is preferably a hydrogen atom, an alkyl group having from 1 to 6 carbon atoms, a hydroxyl group, an alkoxy group having from 1 to 6 carbon atoms, an acylamino group having from 1 to 6 carbon atoms, an amino group, a dialkylamino group having from 2 to 12 carbon atoms, a ureido group having from 1 to 6 carbon atoms, a sulfamoylamino group having from 1 to 6 carbon atoms, an alkoxycarbonylamino group having from 1 to 6 carbon atoms, an arylsulfonylamino group, an alkylsulfonylamino group having from 1 to 6 carbon atoms, a sulfamoyl group having from 2 to 12 carbon atoms, an arylsulfonyl group, an alkylsulfonyl group having from 1 to 6 carbon atoms, or an imido group having from 4 to 8 carbon atoms and more preferably, a hydrogen atom, or an alkyl group having from 1 to 6 carbon atoms. In the Formulas B-1 to B-14, represents the position at which combines with N in the Formula 1. $n_2$ represents 0 or 1 and $n_3$ represents 0, 1, 2 or 3. When $n_3$ is 2 or more, $R^{31}$ may be the same or different. When $R^{31}$ and $R^{32}$ are capable of forming a ring, the ring formation may be allowed. In the Formulas B-1 to B-14, in case the compound has a condensed ring structure, no number of the ring is particularly limited. However, among them, 5 through 7 membered rings are preferably employed.

As for B of azomethine dye represented by Formula 1, B-3, B-10, B-11, B-12, B-13 and B-14 are preferably employed, further, B-10, B-11, B-12, B-13 and B-14 are more preferably employed, and B-10, B-11 and B-14 are most preferably employed.

In the Formula 1, A represents an atomic group required for causing an absorption in visible ray region and/or near infrared region for the azomethine dye represented by Formula 1. A is the same as those derived from a compound which yields an azomethine dye upon oxidation coupling reaction with p-phenylenediamines. In the present invention, the visible ray region means the wave length region of 380 to 800 nm, and the near-infrared region means the wavelength region of 800 to 1400 nm. The compound which yields A includes phenols, naphthols, heterocyclic compounds having a active hydrogen or open chain type active methylene compounds. Preferred A is represented by the following Formulas a to w.

Formula a

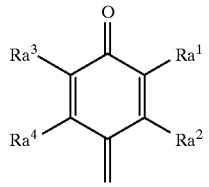

-continued
Formula b
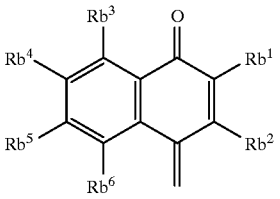
Formula c
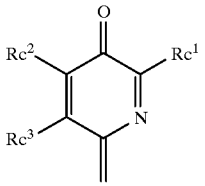
Formula d
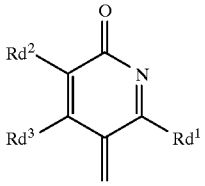
Formula e
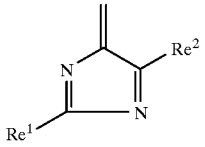
Formula f
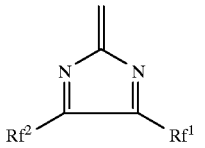
Formula g
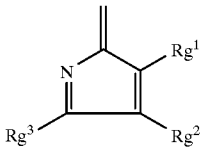
Formula h
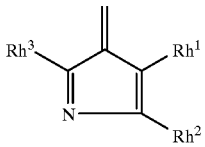
Formula i
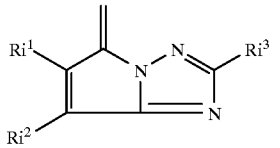
Formula j
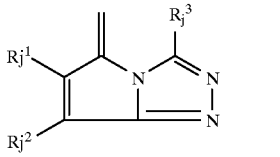
-continued
Formula k
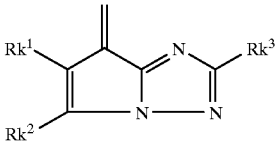
Formula l
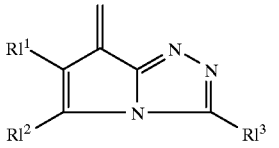
Formula m
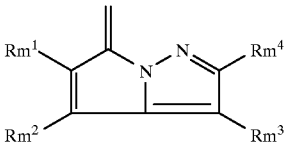
Formula n
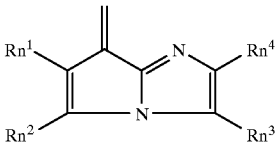
Formula o
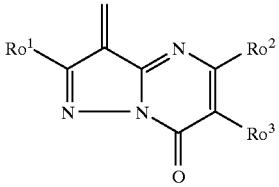
Formula p
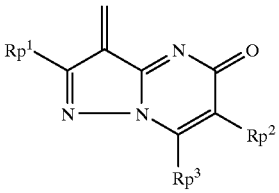
Formula q
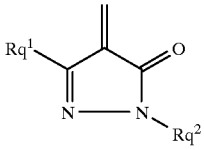
Formula r
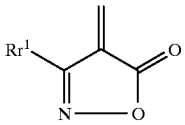
Formula s
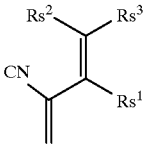

-continued

Formula t

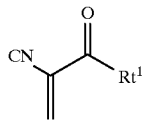

Formula u

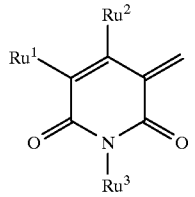

Formula v

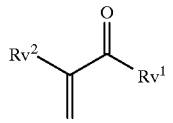

Formula w

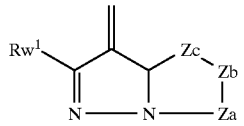

In the following, formulas a, b, c and d are described. $Ra^1$, $Ra^2$, $Ra^3$, $Ra^4$, $Rb^1$, $Rb^2$, $Rb^3$, $Rb^4$, $Rb^5$, Rb6, $Rc^1$, $Rc^2$, $Rc^3$, $Rd^1$, $Rd^2$ and $Rd^3$ each represent a hydrogen atom or a substituent which is the same as that described to $R^{31}$ and $R^{32}$ in B and the examples are also the same.

In the formulas a, c and d, $Ra^1$, $Rc^1$ and $Rd^2$ each are preferably an acylamino group (for example, an acetylamino group, a furoylamino group, 4-hydroxycarbonylbenzoylamino or pivaloylamino group), a carboxylic acid group, or a sulfonic acid group. $Ra^4$, $Rc^3$ and $Rd^1$ each are preferably an acylamino group (for example, pivaloylamino group), an alkyl group (for example, a methyl, ethyl or n-decyl group). $Ra^2$ and $Rd^3$ each are preferably a hydrogen atom and $Ra^3$ and $Rc^2$ each are preferably a chlorine atom or a hydrogen atom.

In the formula b, $Rb^1$ is preferably a carbamoyl group (for example, a 2-hydroxycarbonylphenylcabamoyl, methlycarbamoyl or t-butylcarbamoyl group), a carboxylic acid group or a sulfonic acid group. Rb2, $Rb^3$, $Rb^4$ and $Rb^5$ each are preferably a hydrogen atom, $Rb^6$ is preferably a hydrogen atom, an acylamino group (for example, an acetylamino group) alkylamino carbonyl group or an aryl amino carbonyl group.

In the following, the formulas e and f are explained. $Re^1$, $Re^2$, $Rf^1$ and $Rf^2$ independently represent a hydrogen atom or a substituent which is the same as that described to $R^{31}$ and $R^{32}$ in B and the examples are also the same. Among those, the aryl group (for example, a 2-acetylaminophenyl, 4-hydroxycarbonylphenyl or phenyl group), the alkyl group (for example, a methyl, ethyl, t-butyl or 2-sulfophenylmethyl group) and the heterocyclic group (for example, 2-pyridyl or 2-thienyl group) are preferable.

In the following, the formulas g and h are described. $Rg^1$, $Rg^2$, $Rg^3$, $Rh^1$, $Rh^2$, and $Rh^3$ independently represent a hydrogen atom or a substituent which is the same as that described to $R^{31}$ and $R^{32}$ in B and the examples are also the same. Furthermore, $Rg^1$ and $Rg^2$ and/or $Rg^2$ and $Rg^3$, $Rh^1$ and $Rh^2$ and/or $Rh^2$ and $Rh^3$ may combine each other to form a ring structure. Among those, at least one of $Rg^1$, $Rg^2$, $Rg^3$ and at least one of $Rh^1$, $Rh^2$ and $Rh^3$ are preferably a cyano group, —$CCl_3$, —$CF_3$, —CHO, —$COOCH_3$, —$COCH_3$, a nitro group, —$SO_2CH_3$, etc. and further, an electron attractive group having a Hammett's substituent constant op of 0.30 or more is preferable. In this case, the other two groups are each preferably a cyano group, an acyl group (having from 2 to 12 carbon atoms, for example, an acetyl, pivaloyl or p-hydroxycarbonylbenzoyl group), an alcoxycarbonyl group (having from 2 to 12 carbon atoms, for example, a methaoxycarbonyl or ethaoxycarbonyl group), an aryloxycarbonyl group (having from 7 to 18 carbon atoms, for example, a phenoxycarbonyl or p-sulfophenyloxycarbonyl group), an aminocarbonyl group (having from 1 to 12 carbon atoms, for example, a methylaminocarbonyl or anilinocarbonyl group), an aryl group (having from 6 to 18 carbon atoms, for example, a phenyl, tolyl, p-methoxyphenyl or o-hydroxyphenyl group) or an alkyl group (from 1 to 12 carbon atoms, for example, a methyl, ethyl, allyl or prenyl group having).

In the following, the formulas i and j are described. $Ri^1$, $Ri^2$, $Ri^3$, $Rj^1$, $Rj^2$ and $Rj^3$ independently represent a hydrogen atom or a nonmetallic substituent which is the same as that described to $R^{31}$ and $R^{32}$ in B, and the examples are also the same. Furthermore, $Ri^1$ and $Ri^2$, and $Rj^1$ and $Rj^2$ may combine each other to form a ring structure.

Among those, $Ri^1$ and $Rj^1$ each are preferably an electron attractive group having a Hammett's substituent constant op of 0.15 or more. Examples include a trichloromethyl, trifluoromethyl, cyano, methoxycarbonyl, acetyl group, a chlorine atom or a methanesulfonyl group.

$Ri^2$ and $Rj^2$ each are preferably a cyano group, an acyl group (having from 2 to 12 carbon atoms, for example, an acetyl, pivaloyl, or p-hydroxycarbonylbenzoyl group), an alkoxycarbonyl group (having from 2 to 12 carbon atoms, for example, a methoxycarbonyl or ethoxycarbonyl group), an aryloxycarbonyl group (having from 7 to 18 carbon atoms, for example, a phenoxycarbonyl or p-sulfophenyloxycarbonyl group), an aminocarbonyl group (having from 1 to 12 carbon atoms, for example, a methylaminocarbonyl or anilinocarbonyl group), an aryl group (having from 6 to 18 carbon atoms, for example, a phenyl, tolyl, p-methoxyphenyl or o-hydroxyphenyl group), an alkyl group (having from 1 to 12 carbon atoms, for example, a methyl, ethyl, aryl or prenyl group). $Ri^3$ and $Rj^3$ each are preferably an alkyl group (having from 1 to 12 carbon atoms, for example, a methyl, ethyl or methoxyethyl group) or an aryl group (having from 6 to 18 carbon atoms, for example, a phenyl, o-chlorophenyl or 3,5-dihydroxycarbonylphenyl group).

In the following, the formulas k and l are described. $Rk^1$, $Rk^2$, $Rk^3$, $Rl^1$, $Rl^2$ and $Rl^3$ represent independently a hydrogen atom or a substituent which is the same as that described to $R^{31}$ and $R^{32}$ in B and the examples are also the same. Furthermore, $Rk^1$ and $Rk^2$, and $Rl^1$ and $Rl^2$ may combine each other to from a ring structure.

Among those, $Rk^1$ and $Rl^1$ are each preferably an electron attractive group having a Hammett's substituent constant op of 0.15 or more and examples are the same as those described to $Ri^1$ in the formula i. $Rk^2$ and $Rl^2$ are preferably the same as the examples which are shown as the preferred examples described to $Ri^2$ in the formula i. $Rk^3$ and $Rl^3$ are preferably the same as the examples which are shown as the preferred examples described to $Ri^3$ in the formula i. In the following, the formulas m and n are described. $Rm^1$, $Rm^2$, $Rm^3$, $Rm^4$, $Rn^1$, $Rn^2$, Rn3 and $Rn^4$ represent independently a hydrogen atom or a substituent which is the same as that described to $R^{31}$ and $R^{32}$ in B and the examples are also the same.

In addition, $Rm^1$ and $Rm^2$ and/or $Rm^2$ and $Rm^3$ and/or $Rm^3$ and $Rm^4$, $Rn^1$ and $Rn^2$ and/or $Rn^2$ and $Rn^3$ and/or $Rn^3$ and $Rn^4$ may combine each other to from a ring structure. Among those, $Rm^1$ and $Rn^1$ each are preferably an electron attractive group having a Hammett's substituent constant op of 0.15 or more and the examples are the same as those described to $Ri^1$ in the formula i. $Rm^2$ and $Rn^2$ each are preferably the same as the examples which are shown as the preferred examples described to $Ri^2$ in the formula i.

$Rm^3$ and $Rn^3$ each are preferably an alkyl group (having from 1 to 12 carbon atoms, for example, a methyl, ethyl or t-butyl group), an aryl group (having from 6 to 18 carbon atoms, for example, a phenyl, tolyl, p-methoxyphenyl or o-hydroxyphenyl group), a cyano group, an acyl group (having from 2 to 12 carbon atoms, for example, an acetyl, pivaloyl or p-hydroxycarbonylbenzoyl group), an alkoxycarbonyl group (having from 2 to 12 carbon atoms, for example, a methoxycarbonyl or ethoxycarbonyl group), an aryloxycarbonyl group (having from 7 to 18 carbon atoms, for example, a phenoxycarbonyl or p-methoxyphenylcarbonyl group) or an aminocarbonyl group (having from 1 to 12 carbon atoms, for example, a methylaminocarbonyl or anilinocarbonyl group).

$Rm^4$ and $Rn^4$ each are preferably the same as the examples which are shown as the preferred examples for $Ri^3$ in the formula (i).

In the flowing, the formula o and p are described. $Ro^1$, $Ro^2$, $Ro^3$, $Rp^1$, $Rp^2$ and $Rp^3$ represent independently a hydrogen atom or a substituent which is the same as that described to $R^{31}$ and $R^{32}$ in B and the examples are also the same. $Ro^1$ and $Rp^1$ each are preferably an alkyl group (having from 1 to 12 carbon atoms, for example, a methyl, ethyl, t-butyl or pentafluoroethyl group), an aryl group (for example, a phenyl, trichlorophenyl, o-sulfophenyl, m-chlorophenyl, 3,5-dichlorophenyl, m-cyanophenyl or m-trifluoromethylphenyl group).

$Ro^2$, $Ro^3$, $Rp^2$ and $Rp^3$ each are preferably a hydrogen atom, an alkyl group, an aryl group, an alkoxy group, an amino group, an acyl group, an alkoxycarbonyl group, an aminocarbonyl group, a carboxylic acid group or a sulfonic acid group. Among those, the most preferred ones are the alkyl group (comprising a group having a substituent; having from 1 to 12 carbon atoms, for example, a t-butyl, i-propyl, methyl ethyl, n-propyl, n-butyl or trifluoromethyl group, etc.), the aryl group (comprising a group having a substituent; having from 6 to 18 carbon atoms, for example, a phenyl, 4-hydroxycarbonylphenyl group, etc.). Furthermore, $Ro^2$ and $Ro^3$, and $Rp^2$ and $Rp^3$ preferably combine each other to form an aromatic ring or a heterocylic aromatic ring.

In the following, the formulas q and r are described. $Rq^1$, $Rq^2$ and $Rr^1$ represent independently a hydrogen atom or a substituent which is the same as that described to $R^{31}$ and $R^{32}$ in B, and the examples are also the same. $Rq^1$ and $Rr^1$ each are preferably an acylamino group (for example, an acetylamino or benzoylamino group), an anilino group (for example, a methylamino, anilino or o-chloroanilino group) and an alkyl group (for example, a methyl, ethyl, or t-butyl group), a carbamoyl group (for example, a carbamoyl or methylcarbamoyl group), a cyano group, and a carboxylic acid group. $Rq^2$ is preferably a hydrogen atom, an alkyl group (having from 1 to 12 carbon atoms, for example, a methyl, ethyl, hydroxyethyl, or 2-hydroxycarbonylbenzyl, 2,4,6-trichlorophenylmethyl or 2-phenetyl group) and an aryl group (for example, a phenyl, 2,4,6-trichlorophenyl, 3,5-dichlorophenyl or 4-hydroxycarbonylphenyl group).

In the following, the formulas s and t are described. $Rs^1$, $Rs^2$, $Rs^3$, $Rt^1$ and $Rt^2$ represent independently a hydrogen atom or a nonmetallic substituent which is the same as that described to $R^{31}$ and $R^{32}$ in B and the examples are also the same. In the formula t, $Rt^1$ is preferably a phenyl group, a naphthyl group, a furan ring group or a chroman ring group.

In the formula s, $Rs^1$ represents a cyano group, a phenyl group, a heterocyclic group, etc. an amino group.

Either $Rs^2$ or $Rs^3$ is preferably a cyano group and the other is preferably a cyano group, an alkoxycarbonyl group (for example, a methoxycarbonyl or ethoxycarbonyl group).

In the following, the formula u is described. $Ru^1$, $Ru^2$ and $Ru^3$ represent independently a hydrogen atom or a group which is the same as that described to $R^{31}$ and $R^{32}$ in B and the examples are also the same.

Furthermore, $Ru^1$ and $Ru^2$ may combine to form a ring structure. Among those, $Ru^1$ is preferably an alkyl group (having from 1 to 12 carbon atoms, for example, a methyl, ethyl, methoxyethyl or p-sulfobenzyl group), an aryl group (having from 6 to 18 carbon atoms, for example, a phenyl, o-hydroxycarbophenyl or 3,5-dihydroxycarbonylphenol group), a heterocyclic group (having from 4 to 18 carbon atoms, for example, a 2-furyl, 2-thienyl, 2-pyrimidinyl, imidazolyl or pyrazolyl group). $Ru^2$ is preferably a cyano group, an acyl group (having from 2 to 12 carbon atoms, for example, an acetyl, pivaloyl or p-hydroxycarbonylbenzoyl group), an alkoxycarbonyl group (having from 2 to 12 carbon atoms, for example, a methoxycarbonyl or ethoxycarbonyl group), an aryloxycarbonyl group (having from 7 to 18 carbon atoms, for example, a phenoxycarbonyl or p-sulfophenylcarbonyl group), an aminocarbonyl group (having from 1 to 12 carbon atoms, for example, a methylaminocarbonyl or anilinocarbonyl group), an aryl group (having from 6 to 18 carbon atoms, for example, a phenyl, tolyl, p-methoxyphenyl, or o-hydroxyphenyl group) or an alkyl group (having from 1 to 12 carbon atoms, for example, a methyl, ethyl, allyl or prenyl group).

$Ru^3$ is preferably an alkyl group (having from 1 to 12 carbon atoms, for example, a methyl, ethyl, or hydroxycarbonylethyl group), an aryl group (having from 6 to 18 carbon atoms, for example, a phenyl, o-chlorophenyl or 3,5-dihydroxycarbonylphenyl group).

In the following, the formula v is described. $Rv^1$ and $Rv^2$ represent independently a hydrogen atom or a substituent which is the same as that described to $R^{31}$ and $R^{32}$ in B, and the examples are also the same. Furthermore, $Rv^1$ and $Rv^2$ may combine to from a ring structure.

Among those, $Rv^1$ is preferably an alkyl group, an amino group (including an alkylamino or anilino group), an aryl group, or a heterocyclic group. $Rv^2$ is preferably a heterocyclic group or $Rv^3$—CO—. $Rv^3$ represents an alkyl group, an aryl group, an amino group (including an alkylamino or anilino group), an alkoxy group (including an aryloxy group). $Rv^2$ is particularly preferably $Rv^3$-CO— and $Rv^3$ is particularly preferably an alkyl group (for example an ethyl, i-butyl or t-butyl group), an aryl group (for example, a phenyl, o-sulfophenyl or o-hydroxyphenyl group), an amino group (for example, an anilino group).

The Formula w is described. $Rw^1$ represents a hydrogen atom or a substituent and Za, Zb and Zc represent independently —N═ or —C($Rw^9$)═. $Rw^9$ represents a hydrogen atom or a substituent. Among those represented by the formula w, the more preferred ones are represented by the following Formulas w1 to w6.

Formula w1

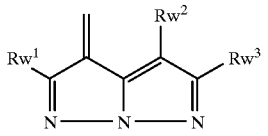

Formula w2

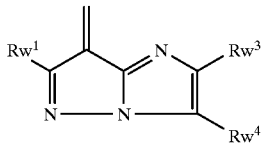

Formula w3

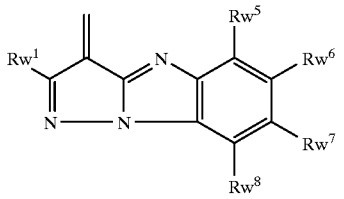

Formula w4

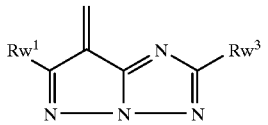

Formula w5

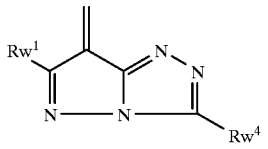

Formula w6

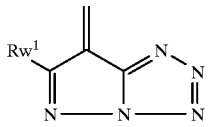

$Rw^1$ represents a hydrogen atom or a substituent which is the same as that described to $R^{31}$ and $R^{32}$ and the examples are also the same. $Rw^1$ is preferably an alkyl group (having from 1 to 12 carbon atoms), an alkoxy group (having from 1 to 12 carbon atoms), an aryl group (having from 1 to 12 carbon atoms), a heterocyclic group (having from 2 to 12 carbon atoms), a carboxylic acid group, a sulfonic acid group or an acylamino group (having from 2 to 12 carbon atoms).

$Rw^2$, $Rw^3$ and $Rw^4$ represent independently a hydrogen atom or a substituent. Among those, is preferably a hydrogen atom, an alkyl group, an aryl group, an alkoxy group, an amino group, an acyl group, an alkoxycarbonyl group, an aminocarbonyl group, a carboxylic acid group or a sulfonic acid group. Among those, are most preferred ones the alkyl group (including the groups having a substituent; having from 1 to 12 carbon atoms, for example, a t-butyl, i-propyl, methyl, ethyl, n-propyl, n-butyl or trifluoromethyl group, etc.), an aryl group (including ones having a substituent; having from 6 to 18 carbon atoms, for example, a phenyl, 4-hydroxycarbonylphenyl group, etc.)

$Rw^5$, $Rw^6$, $Rw^7$ and $Rw^8$ are the same as those described to $R^{31}$ and $R^{32}$ and the examples are also the same. In $Rw^5$, $Rw^6$, $Rw^7$ and $Rw^8$, the most preferred one is the hydrogen atom, the alkyl group (having from 1 to 12 carbon atoms), the halogen atom, the carboxylic acid group, the sulfonic acid group or the hydroxyl group.

As for A of azomethine dye represented by Formula 1, the following Formulas 2 through 10 are preferably employed.

Formula 2

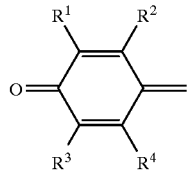

Formula 3

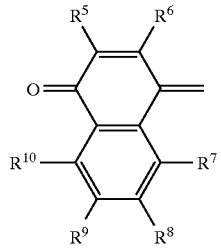

Formula 4

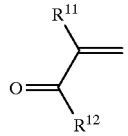

Formula 5

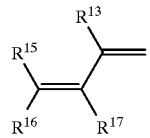

Formula 6

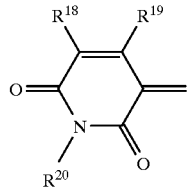

Formula 7

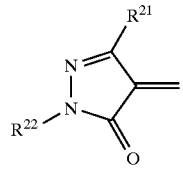

-continued

Formula 8

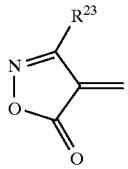

Formula 9

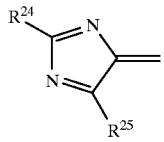

Formula 10

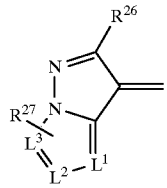

wherein $R^1$ to $R^{27}$ each represent a hydrogen atom or a substituent and $L^1$ to $L^3$ each represent a nitrogen atom or —$CR^{28}$=. Further, $R^{28}$ represents a hydrogen atom or a substituent.

$R^1$through $R^4$ of Formula 2 are the same as those described to $Ra^1$ through $Ra^4$ of Formula a, $R^5$ through $R^{10}$ of Formula 3 are the same as those described to $Rb^1$ through $Rb^6$ of Formula b, $R^{11}$ and $R^{12}$ of Formula 4 are the same as those described to $Rv^1$ and $Rv^2$ of Formula v.

As for $R^{13}$ through $R^{17}$ of Formula 5, substituents described to $Rs^1$, $Rs^2$ and $Rs^3$ of Formula s are mentioned.

$R^{18}$ through $R^{20}$ of Formula 6 are the same as those described to $Ru^1$, $Ru^2$ and $Ru^3$ of Formula u, $R^{21}$ and $R^{22}$ of Formula 7 are the same as those described to $Rq^1$ and $Rq^2$ of Formula q, $R^{23}$ of Formula 8 is the same as $Rr^1$ of Formula r, $R^{24}$ and $R^{25}$ of Formula 9 are the same as those described to $Re^1$ and $Re^2$ of Formula e, $R^{26}$, $R^{27}$, $L^1$, $L^2$ and $L^3$ of Formula 10 are the same as those described to $Rw^1$, $Rw^3$, Za, Zb and Zc of Formula w1.

As for A of azomethine dye represented by Formula 1, Formulas 2, 3, 4, 7, 8, 9 and 10 are preferably employed, and further, Formulas 4, 7, 9 and 10 are more preferably employed.

Among azomethine dyes employed in the present invention, a preferred one is that wherein A has the structure represented by Formulas 2 to 10 and B has the structure represented by B-10, B-11 or B-14, and more preferred one is that wherein A has the structure represented by Formulas 4, 7, 9 or 10, and B has the structure represented by B-10, B-11 or B-14. In the above-mentioned Formulas 2 to 10, $R^1$ to $R^{28}$ represent independently a hydrogen atom, a halogen atom or a monovalent substituent which is the same as that described to $R^{31}$ and $R^{32}$ in B and the examples are also the same.

In the following, examples of dyes represented by the above-mentioned Formula 1 are illustrated. However, the present invention is not limited by those example.

D-1

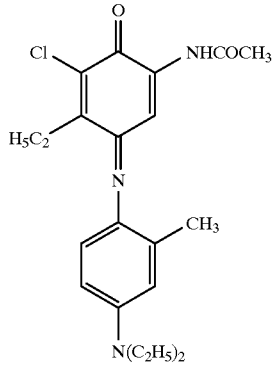

D-2

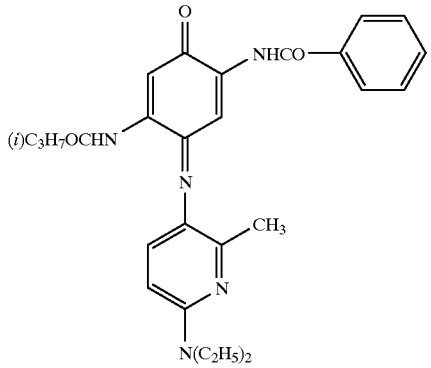

D-3

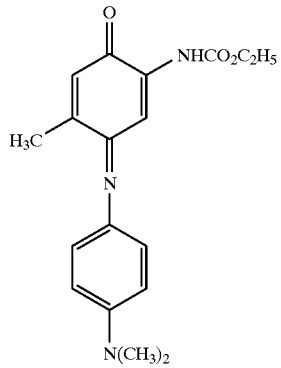

D-4

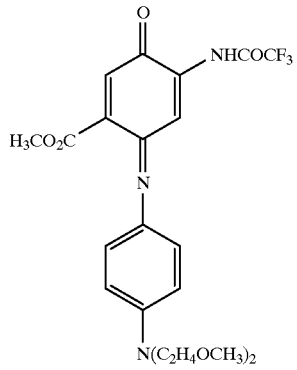

-continued
D-5
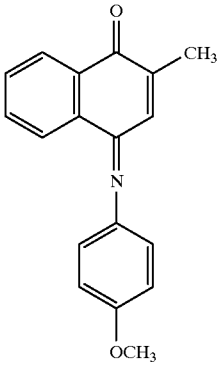
D-6
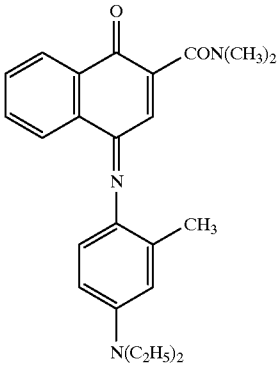
D-7
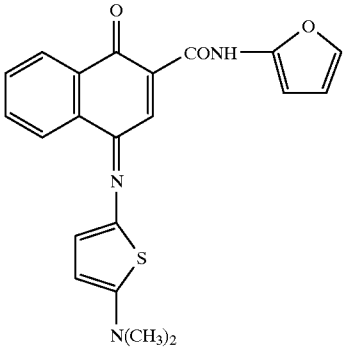
D-8
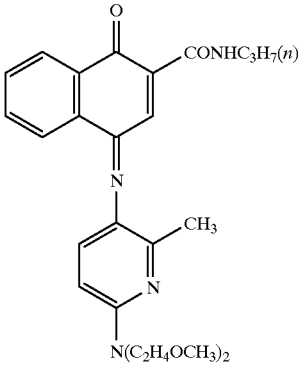
-continued
D-9
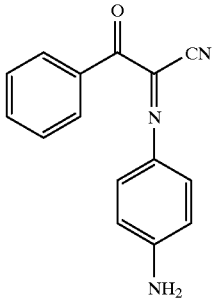
D-10
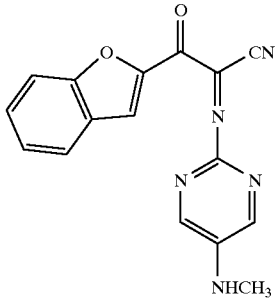
D-11
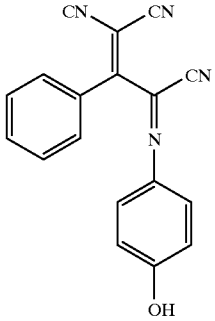
D-12
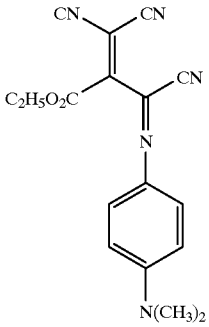
D-13
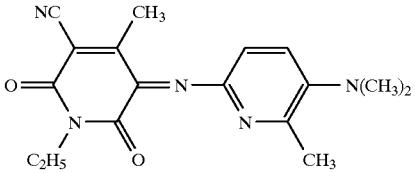

-continued
D-14
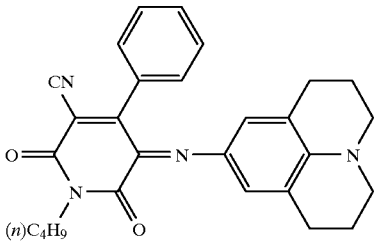
D-15
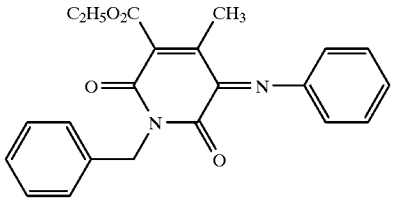
D-16
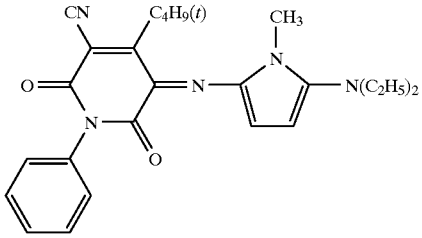
D-17
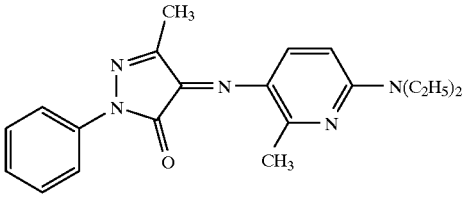
D-18
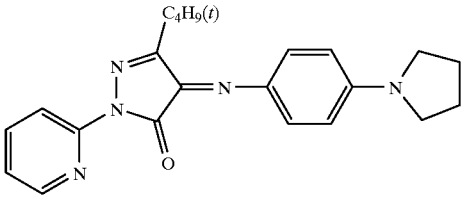
D-19
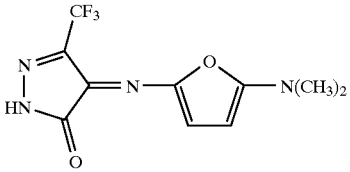
D-20
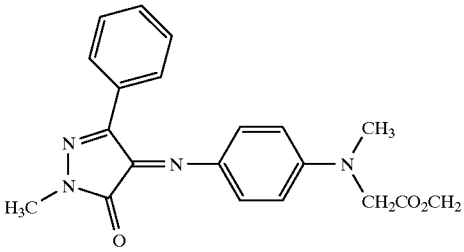
-continued
D-21
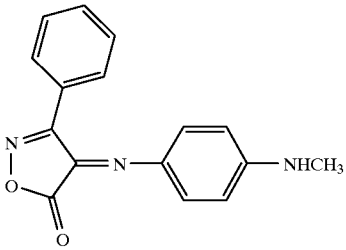
D-22
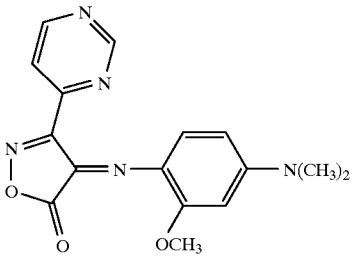
D-23
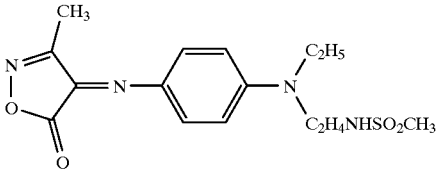
D-24
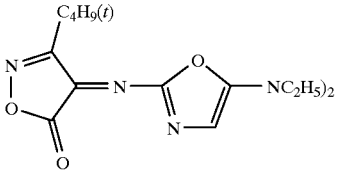
D-25
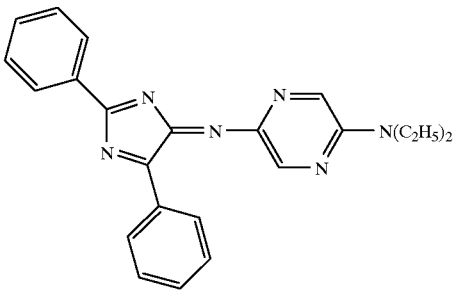
D-26
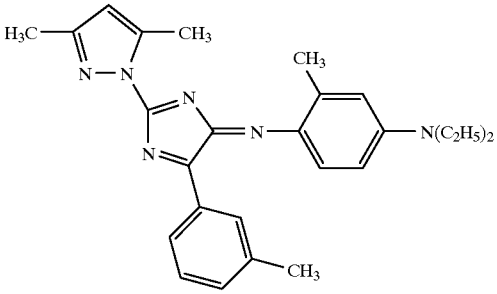

-continued
D-27
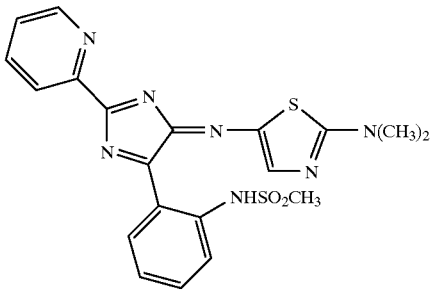
D-28
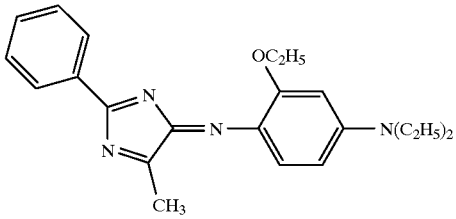
D-29
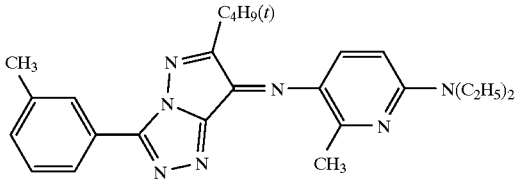
D-30
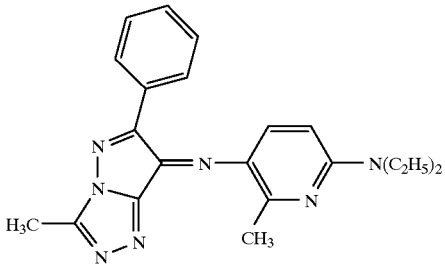
D-31
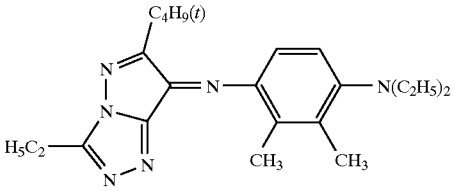
D-32
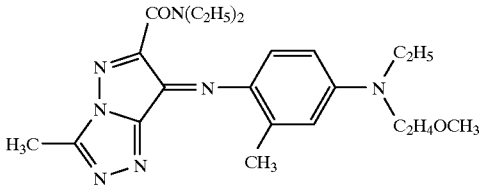
-continued
D-33
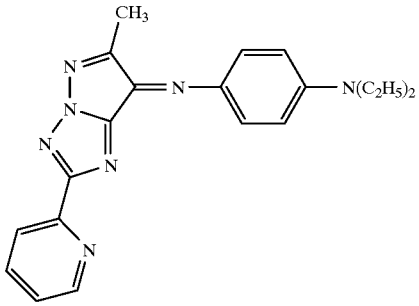
D-34
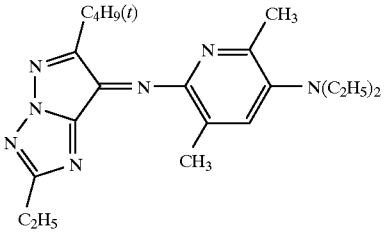
D-35
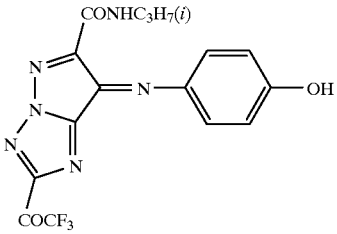
D-36
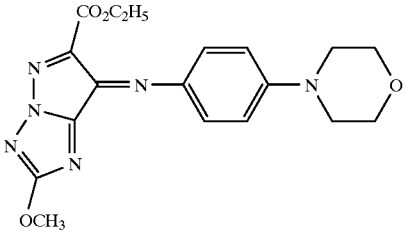
D-37
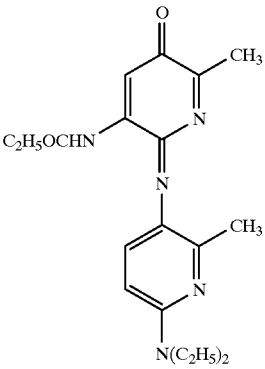

-continued
D-38
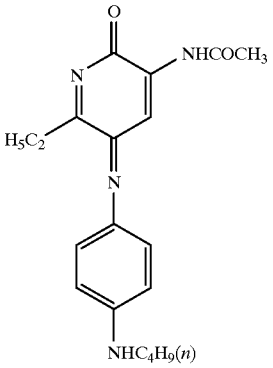
D-39
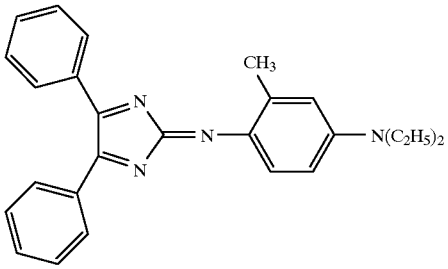
D-40
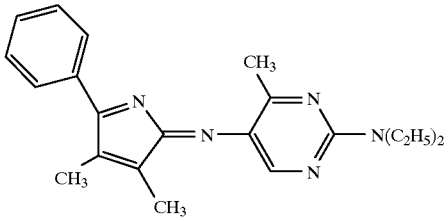
D-41
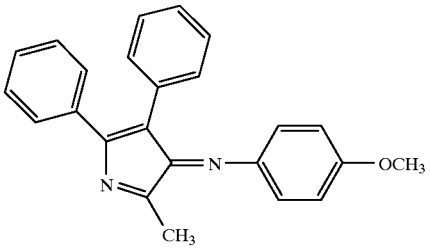
D-42
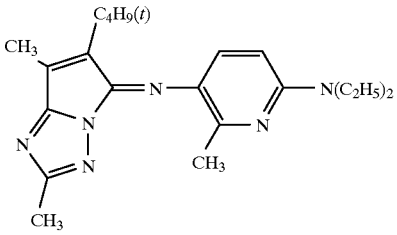
-continued
D-43
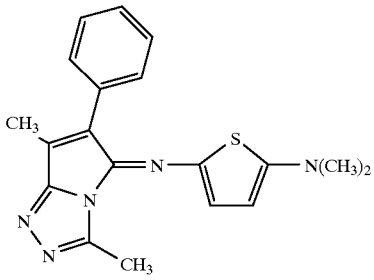
D-44
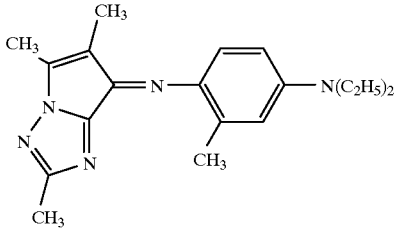
D-45
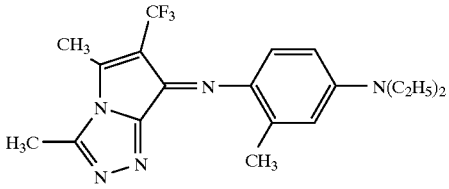
D-46
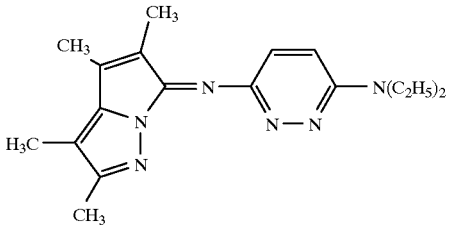
D-47
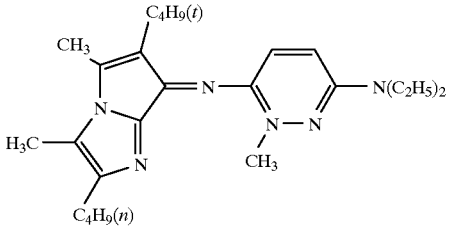
D-48
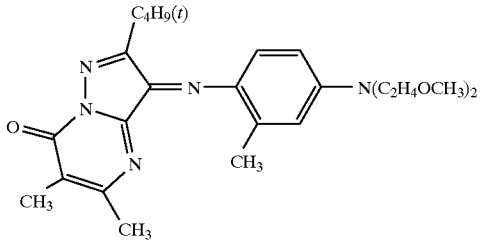

-continued
D-49
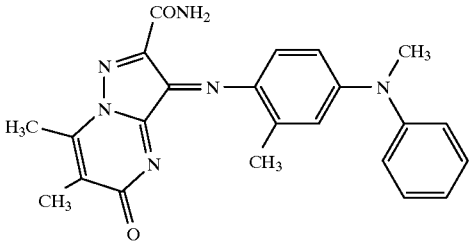
D-50
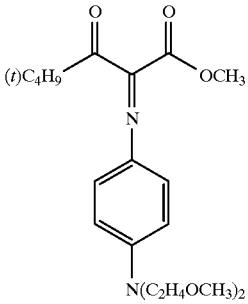
D-51
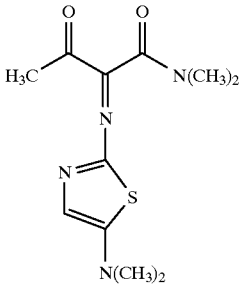
D-52
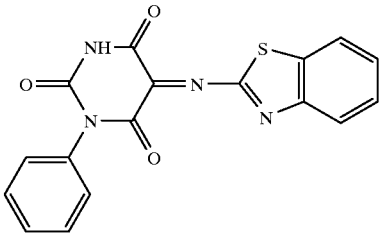
D-53
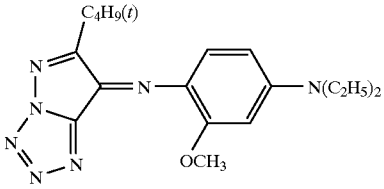
D-54
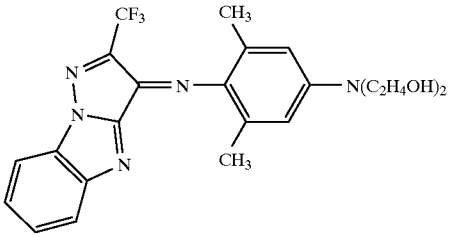
-continued
D-55
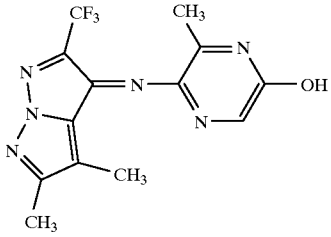
D-56
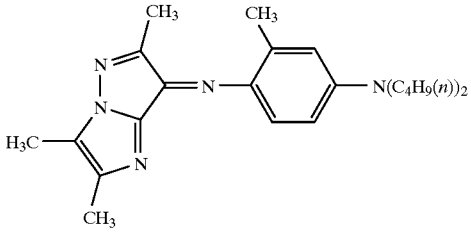
D-57
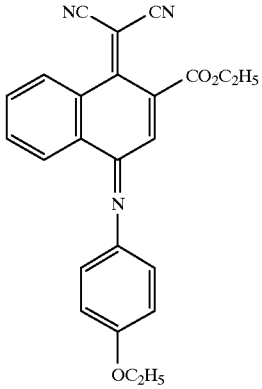
D-58
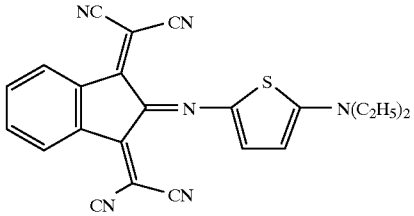
D-59
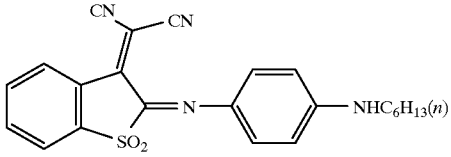
D-60
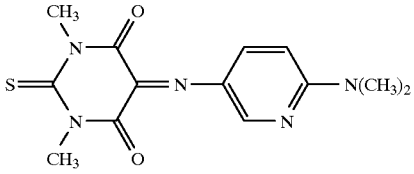

-continued

D-61

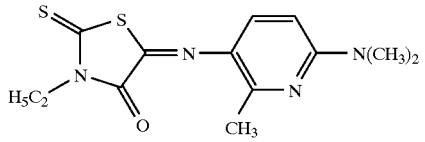

D-62

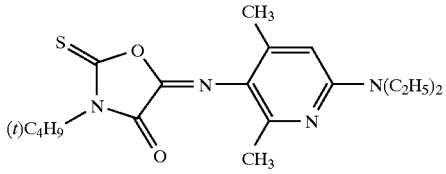

D-63

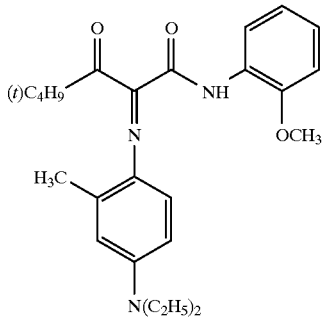

D-64

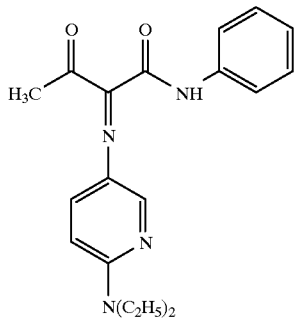

In the following, are shown synthesis examples of dyes employed in the present invention.

Synthesis Example 1

Synthesis Procedures of Illustrated Dye D-29

D-29

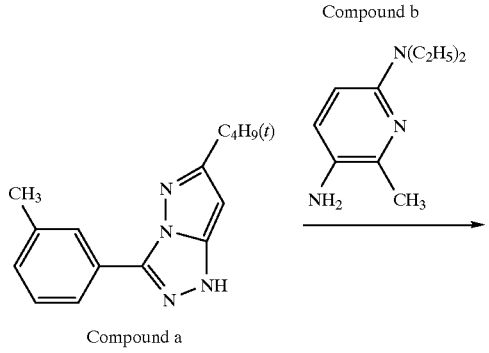

-continued

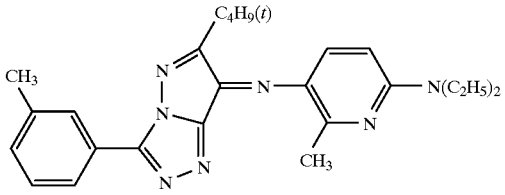

Synthesis Example 1

Synthesis of Illustrated Dye D-29

Four g of the compound a and 200 ml of methanol were mixed and 3.1 g of the compound b was then added. Furthermore, the solution prepared by dissolving 9.1 g of sodium carbonate into 20 ml of water was added with stirring.

Next, an aqueous solution prepared by adding 4.3 g of ammonium persulfate to 20 ml of water was dropped and the resulting solution was stirred for 2 hours. Thereafter, water was further added and crystallized crystals were separated by filtration and recrystallized by acetonitrile . Thus, 3.5 g of the dye D-29 was obtained.

Synthesis Example 2

Synthesis Procedures of Illustrated Dye D-26

D-26

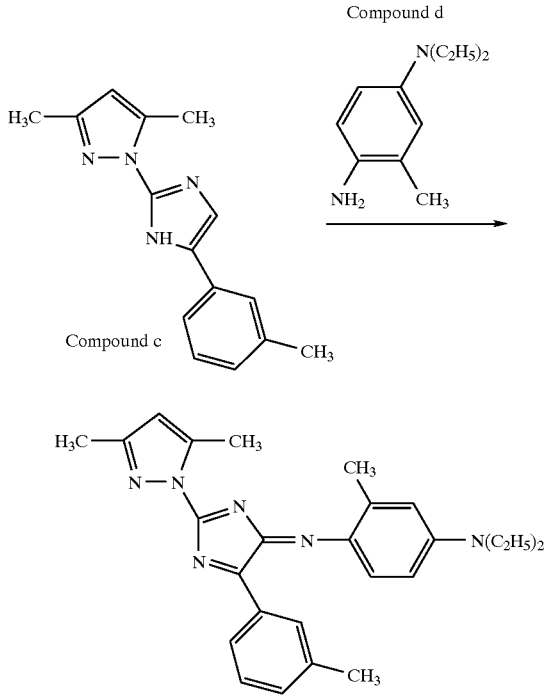

Synthesis Example 2

Synthesis of Illustrated Dye D-26

Two g of the compound c and 2.0 g of the compound d were dissolved into 200 ml of methanol and 25 ml of an aqueous 20% potassium carbonate solution was then added. Thereafter, 5 ml of an aqueous 30% ammonium persulfate solution was dropped and the resulting solution was further stirred for 2 hours.

Thereafter, water was further added and crystallized solid was separated by filtration and recrystsallized by acetonitrile. Thus, 1.2 g of the dye D-26 was obtained.

An addition amount of the azomethine dye of the present invention to a toner is 0.01 to 15 parts by weight and preferably 1.0 to 10 parts by weight to a binder resin (or binding resin). As the binder resin for the toner, can be employed all the binders generally used. For example, are illustrated styrene resins, acryl resins, styrene/acryl resins, polyester resins, etc.

In the present invention, inorganic fine particles and organic fine particles may be externally added for the improvement in fluidity, charge control, etc. for the toner. Silica fine particles and titania fine particles are preferably employed of which surfaces are treated with a coupling agent containing an alkyl group and the like. Further, the number average primary particle diameter of these particles is preferably 10 to 500 nm and the addition amount to the toner is preferably 0.1 to 20 weight percent.

As release agents, may be employed all the release agents conventionally used. Specifically, are illustrated olefins such as low molecular weight polypropylene, low molecular weight polyethylene, ethylene-propylene copolymer, etc., microcrystalline wax, carnauba wax, sazor wax, paraffin wax, etc. An addition amount of these is preferably 1 to 5 weight percent of the toner.

A charge control agent may be added as required. However, the colorless agent is preferable from the point of the formation of color. For example, are illustrated agents having a quartenary ammonium salt structure, Calixarene structure, etc. As a carrier, either non-coated carrier composed of only particles of a magnetic material such as iron, ferrite, etc. or resin coated carrier wherein the surfaces of magnetic particles are covered with a resin, etc. may be employed. The average diameter of the carrier is preferably 15 to 150 $\mu$m in a volume average diameter.

No imaging method to which the toner of the present invention is applied is particularly limited. For example, there are provided methods wherein a color image is repeatedly formed on a photoreceptor and thereafter, the resulting images are transferred to form the color image, or an image formed on a photoreceptor is successively transferred to an intermediate transfer member and a color image is formed on the intermediate transfer member and thereafter, the color image is formed by transferring the resulting color image to a image forming material such as paper, etc.

EXAMPLE

In the following, the present invention is explained in detail with the reference to examples. However, it should be noted that the embodiments of the present invention are not limited by the examples herein. Furthermore, "parts" hereinafter are "by weight", unless otherwise indicated. Preparation of Samples (Colorant)

| Azomethine dyes of the present invention D-26(C), D-29(M), D-63(Y) | |
|---|---|
| Comparative Y Pigment 1 | C.I. PIGMENT YELLOW10 |
| Comparative Y Pigment 2 | C.I. PIGMENT YELLOW17 |
| Comparative Y Pigment 3 | C.I. PIGMENT YELLOW154 |
| Comparative Y Pigment 4 | C.I. PIGMENT YELLOW185 |
| Comparative Y Dye 1 | C.I. SOLVENT YELLOW29 |
| Comparative M Pigment 1 | C.I. PIGMENT RED57 : 1 |
| Comparative M Pigment 2 | C.I. PIGMENT RED81 : 1 |
| Comparative M Pigment 3 | C.I. PIGMENT RED122 |
| Comparative M Dye 1 | C.I. SOLVENT RED152 |
| Comparative C Pigment 1 | C.I. PIGMENT BLUE1 |
| Comparative C Pigment 2 | C.I. PIGMENT BLUE15 : 3 |
| Comparative C Dye 1 | C.I. SOLVENT BLUE38 |
| Comparative C DYE 2 | C.I. SOLVENT BLUE70 |

(Y: yellow, M: magenta, C: cyan)

(Preparation of Colored Toner)

One hundred parts of a polyester resin, parts indicated below of each colorant and 3 parts of polypropylene were mixed, kneaded, pulverized and classified, and powder having a volume average particle diameter of 8.5 $\mu$m was obtained.

Furthermore, 100 parts of the powder and 1.0 part of silica fine particles (particle size of 12 nm, a degree of hydrophobicity 60) were mixed in a Henschel mixer and the colored toner was obtained.

| Addition of colorants by parts | | |
|---|---|---|
| Yellow | Dye D-63 of present invention | 4 parts |
| | Comparative Y pigment and dye | 4 parts |
| Magenta | Dye D-29 of present invention | 2 parts |
| | Comparative M pigment and dye | 2 parts |
| Cyan | Dye D-26 of present invention | 2 parts |
| | Comparative C pigment and dye | 2 parts |

(Preparation of Carrier)

Forty g of fine particles of a copolymer of styrene/methylmethacrylate=6/4, 1960 g of Cu—Zn ferrite particles having a specific gravity of 5.0, a weight average particle size of 45 $\mu$m, and a saturation magnetization of 25 emu/g at the application of external magnetic field of 1,000 oersted were placed in a mixer with a high speed stirrer and mixed at 30° C. for 15 minutes. The resulting mixture was subjected repeatedly to mechanical impact force for 30 minutes at 105° C. and cooled. Thus, the carrier was prepared.

(Preparation Developer)

In a V type mixer, 418.5 g of the above-mentioned carrier and 31.5 g of each toner were mixed for 20 minutes and developers for specific copying tests were prepared.

(Evaluation Apparatus and Conditions)

In Example, the specific copying evaluation was performed using the Konica 9028 (manufactured by Konica Corp.) as an imaging apparatus.

(Evaluation Items, Methods)

Reflection images (image on plain paper) and transmission images (OHP image) were prepared by the above-mentioned imaging method with the use of the colored toners of the present invention. The resulting images were evaluated by the following method. Furthermore, the evaluation was performed under the range of toner adhesion of 0.7±0.05 mg/cm$^2$.

Chroma:

The chroma of the image on plain paper was measured using the Macbeth Color-Eye 7000 wherein ASTM D65 2°. Visible region was mounted as a light source and results were compared.

Light Fastness:

The exposure test for 7 days was conducted using the "Xenon Long Life Weather Meter" manufactured by Suga Shikenki Co. (Xenon arc lamp, 70,000 lux, 44.0° C.). Thereafter, the difference in color between before and after the test was measured by the use of Macbeth Color-Eye 7000, and then, the color difference was calculated by CMC (2:1) color difference equation and compared.

Transparency:

The transparency of the OHP image was evaluated by the following method. The spectral transmittance of visible region of the image was measured using "330 Type Automatic Recording Spectrophotometer manufactured by Hitachi, Ltd., while utilizing the OHP transparency having no toner image as a reference and the spectral transmittances for yellow at 570 nm, magenta at 650 nm and cyan at 500 nm were obtained thereby to make a scale for the evaluation of the transparency of the OHP image.

Variation in Hue

The variations in hue of the prepared image on plain paper and OHP image were measured using the Macbeth Color-Eye 7000 wherein ASTM D65 2° visible region was mounted as a light source and results were compared.

(Evaluation Results)

Table 1 shows the obtained results.

TABLE 1

| | Dye of Present Invention or C.I. No. | Chroma | Light Fastness | Trans-parency | Variation in Hue |
|---|---|---|---|---|---|
| Example 1 | D-63 | 97.8 | 0.1 | 75.0 | −2.1 |
| Comparative Example 1 | C.I. PIGMENT YELLOW 10 | 74.2 | 0.1 | 61.1 | −6.5 |
| Comparative Example 2 | C.I. PIGMENT YELLOW 17 | 84.4 | 0.1 | 60.5 | −2.8 |
| Comparative Example 3 | C.I. PIGMENT YELLOW 154 | 69.4 | 0.2 | 60.4 | −5.7 |
| Comparative Example 4 | C.I. PIGMENT YELLOW 185 | 97.7 | 1.1 | 46.1 | −8.0 |
| Comparative Example 5 | C.I. SOLVENT YELLOW 29 | 92.2 | 0.8 | 73.3 | 11.9 |
| Example 2 | D-29 | 77.0 | 0.1 | 69.4 | −10.1 |
| Comparative Example 6 | C.I. PIGMENT RED 57:1 | 70.1 | 2.1 | 55.0 | −11.4 |
| Comparative Example 7 | C.I. PIGMENT RED 81:1 | 75.4 | 4.5 | 57.3 | −30.5 |
| Comparative Example 8 | C.I. PIGMENT RED 122 | 75.2 | 0.1 | 58.0 | −13.3 |
| Comparative Example 9 | C.I. SOLVENT RED 155 | 76.1 | 6.4 | 69.4 | −12.4 |
| Example 3 | D-26 | 60.0 | 0.1 | 85.7 | −10.4 |
| Comparative Example 10 | C.I. PIGMENT BLUE 1 | 55.8 | 2.4 | 70.3 | −22.4 |
| Comparative Example 11 | C.I. PIGMENT BLUE 15:3 | 53.1 | 0.1 | 82.1 | −35.4 |
| Comparative Example 12 | C.I. SOLVENT BLUE 38 | 50.0 | 7.0 | 85.6 | −36.7 |
| Comparative Example 13 | C.I. SOLVENT BLUE 70 | 48.4 | 8.2 | 84.4 | −12.5 |

As clearly shown in Table 1, with the use of the colored toner of the present invention, the faithful color reproduction and high OHP quality are obtained. Accordingly, the colored toner of the present invention is suitably utilized for full color process. Furthermore, because the light fastness is excellent, it is possible to prepare the image which can be displayed for a long period of time.

What is claimed is:

1. A color toner for developing an electrostatic latent image, said color toner comprising a binder resin and an azomethine dye having absorption at visible wavelength region or near-infrared wavelength region represented by Formula 1:

$A{=}N{-}B$ Formula 1 wherein A represents a moiety selected from the group consisting of Formulas 2 to 10:

Formula 2

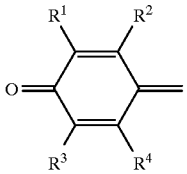

Formula 3

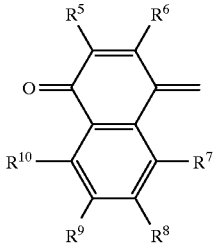

Formula 4

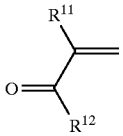

Formula 5

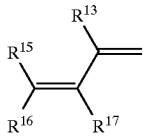

Formula 6

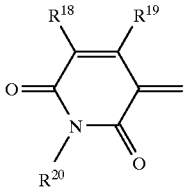

Formula 7

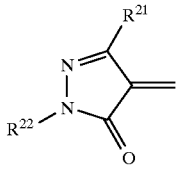

-continued

Formula 8

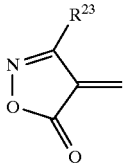

Formula 9

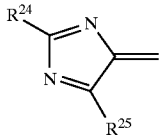

Formula 10

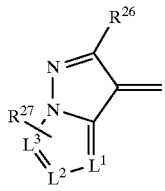

wherein $R^1$ to $R^{27}$ each represent a hydrogen atom or a substituent and $L^1$ to $L^3$ each represent a nitrogen atom or —$CR^{28}$═, and $R^{28}$ represents a hydrogen atom or a substituent; N is a nitrogen atom; and said B represents a non-metal atomic group necessary to form an aromatic hydrocarbon ring, a five-membered heterocyclic aromatic ring or a six-membered heterocyclic aromatic ring.

2. The color toner of claim 1, wherein said B is a moiety selected from a group consisting of Formula B-1 through B-14:

Formula B-1

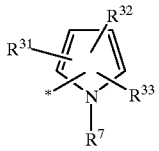

Formula B-2

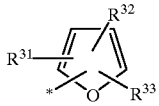

Formula B-3

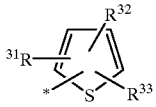

-continued

Formula B-4

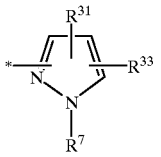

Formula B-5

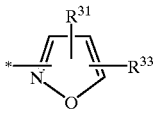

Formula B-6

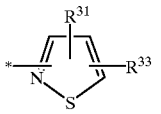

Formula B-7

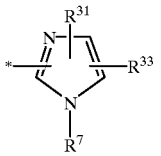

Formula B-8

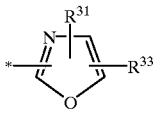

Formula B-9

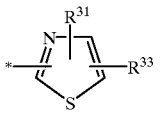

Formula B-10

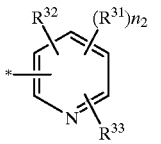

Formula B-11

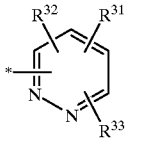

Formula B-12

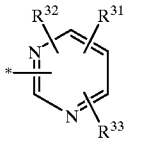

-continued

Formula B-13

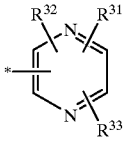

Formula B-14

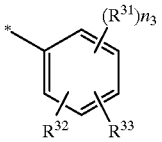

wherein $R^7$ represents an alkyl group or an aryl group, $R^{33}$ represents $OR^{34}$ or $NR^{35}R^{36}$, and $R^{34}$, $R^{35}$ and $R^{36}$ each represents a hydrogen atom, an alkyl group, an aryl group or a heterocyclic group, provided that $R^{35}$ and $R^{36}$, and $R^{35}$ and $R^{31}$, and $R^{31}$ and $R^{36}$ may form a ring in combination; $R^{31}$ and $R^{32}$ represent independently a hydrogen atom, a halogen atom, an alkyl group, an aryl group, a heterocyclic group, a cyano group, a nitro group, a hydroxyl group, a carboxyl group, an alkoxy group, an aryloxy group, an acylamino group, an amino group, an alkylamino group, an anilino group, a ureido group, sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclicoxy group, an azo group, a silyloxy group, an aryloxycarbonylamino group, an imido group, a heterocyclicthio group, a sulfinyl group, a phosphono group, a phosphinyl group, a phosphoryl group, a phospho group, a phosphino group, an aryloxycarbonyl group and an acyl group; $n_2$ is an integer of 0 or 1; $n_3$ is an integer of 0, 1, 2 or 3; * represents a position at which combines with N in Formula 1.

3. The color toner of claim 2, wherein said B is a moiety selected from a group consisting of Formulas B-3, B-10, B-11, B-12, B-13 and B-14.

4. The color toner of claim 3, wherein said B is a moiety selected from a group consisting of Formulas B-10, B-11, B-12, B-13 and B-14.

5. The color toner of claim 4, wherein said B is a moiety selected from a group consisting of Formulas B-10, B-11 and B-14.

6. The color toner of claim 1, wherein said A is a moiety selected from a group consisting of Formulas a through w:

Formula a

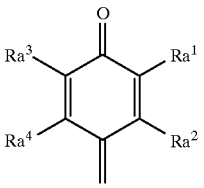

-continued
Formula b
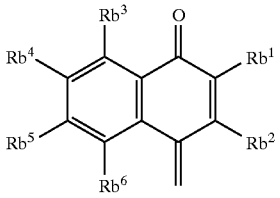
Formula c
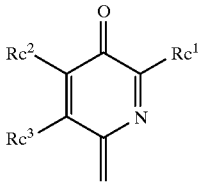
Formula d
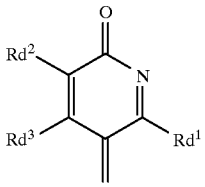
Formula e
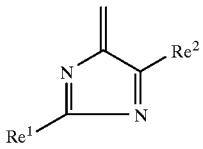
Formula f
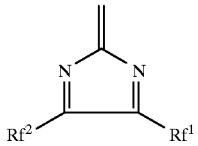
Formula g
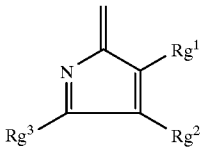
Formula h
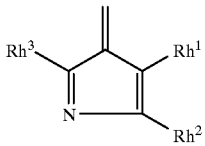
Formula i
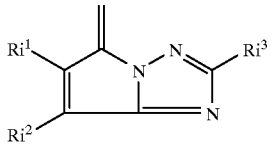
-continued
Formula j
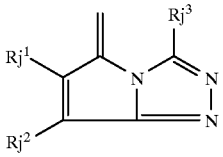
Formula k
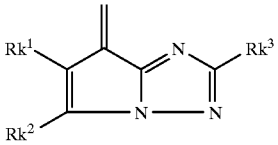
Formula l
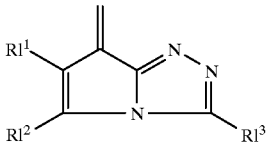
Formula m
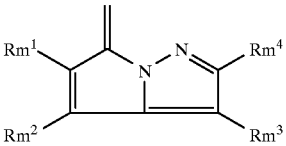
Formula n
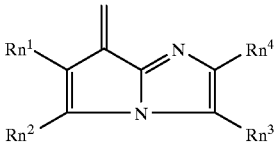
Formula o
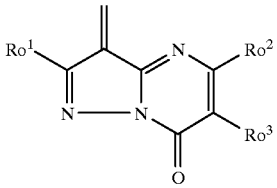
Formula p
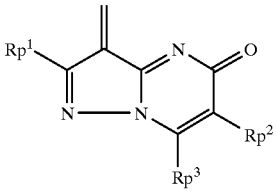
Formula q
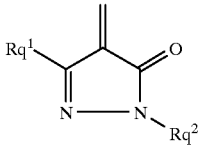

-continued

Formula r

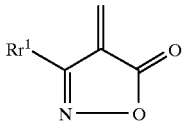

Formula s

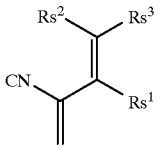

Formula t

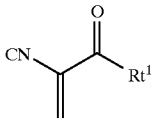

Formula u

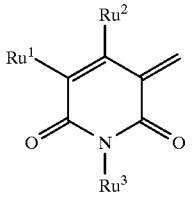

Formula v

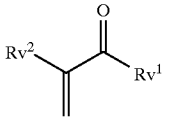

-continued

Formula w

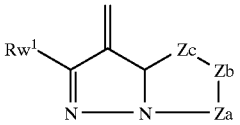

wherein $Ra^1$, $Ra^2$, $Ra^3$, $Ra^4$, $Rb^1$, $Rb^2$, $Rb^3$, $Rb^4$, $Rb^5$, $Rb^6$, $Rc^1$, $Rc^2$, $Rc^3$, $Rd^1$, $Rd^2$ and $Rd^3$ each represent a hydrogen atom or a substituent; $Re^1$, $Re^2$, $Rf^1$ and $Rf^2$ independently represent a hydrogen atom or a substituent; $Rg^1$, $Rg^2$, $Rg^3$, $Rh^1$, $Rh^2$, and $Rh^3$ independently represent a hydrogen atom or a substituent; $Ri^1$, $Ri^2$, $Ri^3$, $Rj^1$, $Rj^2$ and $Rj^3$ independently represent a hydrogen atom or a substituent, provided that $Ri^1$ and $Ri^2$, and $Rj^1$ and $Rj^2$ may combine each other to form a ring structure; $Rk_1$, $Rk^2$, $Rk^3$, $Rl^1$, $Rl^2$ and $Rl^3$ represent independently a hydrogen atom or a substituent, provided that $Rk^1$ and $Rk^2$, and $Rl^1$ and $Rl^2$ may combine each other to from a ring structure; $Rm^1$, $Rm^2$, $Rm^3$, $Rm^4$, $Rn^1$, $Rn^2$, $Rn^3$ and $Rn^4$ represent independently a hydrogen atom or a substituent; $Ro^1$, $Ro^2$, $Ro^3$, $Rp^1$, $Rp^2$ and $Rp^3$ represent independently a hydrogen atom or a substituent; $Rq^1$, $Rq^2$ and $Rr^1$ represent independently a hydrogen atom or a substituent; $Rs^1$, $Rs^2$, $Rs^3$, $Rt^1$ and $Rt^2$ represent independently a hydrogen atom or a substituent; $Ru^1$, $Ru^2$ and $Ru^3$ represent independently a hydrogen atom or a substituent; $Rv^1$ and $Rv^2$ represent independently a hydrogen atom or a substituent, provided that $Rv^1$ and $Rv^2$ may combine to from a ring structure; $Rw^1$ represents a hydrogen atom or a substituent and Za, Zb and Zc represent independently —N═ or —C($Rw^9$)═, $Rw^9$ represents a hydrogen atom or a substituent.

7. The color toner of claim 1, wherein said A is a moiety selected from a group consisting of Formulas 2, 3, 4, 7, 8, 9 and 10.

8. The color toner of claim 7, wherein said A is a moiety selected from a group consisting of Formulas 4, 7, 9 and 10.

* * * * *